US008707530B2

(12) United States Patent
Lin

(10) Patent No.: US 8,707,530 B2
(45) Date of Patent: Apr. 29, 2014

(54) RIVET GUN WITH A CHANGEABLE CYLINDER

(76) Inventor: Yu-Ching Lin, New Taipei (TW)

( * ) Notice: Subject to any disclaimer, the term of this patent is extended or adjusted under 35 U.S.C. 154(b) by 235 days.

(21) Appl. No.: 13/424,417

(22) Filed: Mar. 20, 2012

(65) Prior Publication Data

US 2013/0247345 A1 Sep. 26, 2013

(51) Int. Cl.
*B23P 11/00* (2006.01)

(52) U.S. Cl.
USPC ..... 29/243.521; 29/243.522; 29/243.523; 29/243.524; 29/243.525

(58) Field of Classification Search
CPC .... B21J 15/043; B23P 19/003; B23P 19/006; B23P 19/10; B23P 11/00
USPC ..... 29/243.521, 243.522, 243.523, 29/243.524, 243.525; 72/391.1, 391.6
See application file for complete search history.

(56) References Cited

U.S. PATENT DOCUMENTS 4,704,888 A * 11/1987 Frearson ..... 29/243.525
5,072,501 A * 12/1991 Vincenzo ..... 29/243.525
5,351,379 A * 10/1994 Chu ..... 29/243.525
5,575,051 A * 11/1996 Moore ..... 29/243.523
5,661,887 A * 9/1997 Byrne et al. ..... 29/243.525
6,223,409 B1 * 5/2001 Schruff ..... 29/243.523
6,532,635 B1 * 3/2003 Gregory ..... 29/243.523
6,978,526 B1 * 12/2005 Lin ..... 29/243.525
7,082,658 B1 * 8/2006 Lin ..... 29/243.525
7,284,404 B2 * 10/2007 Lin ..... 72/114
8,091,195 B2 * 1/2012 Lin ..... 29/243.525
8,365,375 B2 * 2/2013 Lin ..... 29/243.525
8,474,119 B2 * 7/2013 Lv et al. ..... 29/243.525
2006/0179631 A1 * 8/2006 Lin ..... 29/243.521

* cited by examiner

*Primary Examiner* — George Nguyen
(74) *Attorney, Agent, or Firm* — Birch, Stewart, Kolasch & Birch, LLP

(57) ABSTRACT

A rivet gun has a barrel, a handle assembly, a cylinder and a seal ring assembly. The handle assembly is mounted under the barrel and has a hydraulic shaft and a handle mounted around the hydraulic shaft and having an annular shoulder. The cylinder has a top cover, an annular body and a bottom seat. The top cover is mounted under the handle and contacts the annular shoulder. A diameter of the top cover is larger than a diameter of the annular shoulder such that an outer periphery of the top cover protrudes radially out from an outer periphery of the annular shoulder instead of being covered by the annular shoulder. The annular body is mounted detachably on the top cover. The bottom seat is mounted detachably on the annular body. The rivet gun is allowed to change cylinders of different sizes or types.

7 Claims, 5 Drawing Sheets

RIVET GUN WITH A CHANGEABLE CYLINDER

BACKGROUND OF THE INVENTION

1. Field of the Invention

The present invention relates to a rivet gun, and more particularly to a rivet gun that has a handle connected detachably to a cylinder. Therefore, the cylinder may be replaced by another cylinder of a different size or type.

2. Description of Related Art

A conventional rivet gun, as disclosed by Taiwan utility model patent No. M400369, is used to rivet two boards such that the boards are securely mounted together by rivets. A rivet has a cap and a core pin. The cap is T-shaped and has an enlarged end and a mounting end. The core pin is mounted longitudinally through and protrudes out of the cap and has two ends and a ball formed on one end and adjacent to the mounting end of the cap.

A conventional rivet gun comprises a barrel, a handle, a trigger, a pin collector and a pneumatic cylinder.

The barrel has a front end, a rear end and a vise assembly that may vise and pull a core pin of a rivet on the front end into the barrel. The handle is mounted perpendicularly on the barrel and has air passageways. The collector is a jar mounted on the rear end of the barrel to collect the ejected core pins. The pneumatic cylinder is mounted movably under the handle and capable of activating the vise assembly through pneumatic and hydraulic means. Furthermore, the pneumatic cylinder may be connected to a high-pressure air source such as an air bottle to implement the ejection of the core pin.

When the rivet gun is used to rivet two pieces such as boards or plates together, a rivet is mounted through the pieces. The enlarged end of the cap of the rivet abuts an inside piece and the front end of the barrel of the rivet gun abuts the enlarged end. The trigger is pulled to activate the vise assembly to pull a core pin on the cap into the barrel. The ball on the core pin longitudinally compresses and radially expands the mounting end of the cap into T-shape so that the expanded mounting end hooks on an outside piece to complete the riveting process. Then, the air output by the high-pressure air source flows through the barrel from the front end to the rear end and sucks the broken core pin vised by the vise assembly backward into the collector.

The bottom of the handle has a flange formed thereon and having a stepped mounting slot formed on a bottom surface of the flange. The pneumatic cylinder has a hollow and annular body and a top cover screwed on a top end of the annular body and having a stepped protrusion formed on the top cover and mounted in the stepped slot of the flange. Therefore, the top cover of the pneumatic cylinder is covered and enclosed by the flange on the bottom of the handle. However, the size of the enclosed top cover of the pneumatic cylinder is limited by the flange of the handle and the annular body such that the size of the annular body corresponding to the top cover is also limited. As a result, the flange of the handle only fits one pneumatic cylinder with a specific size instead of matching pneumatic cylinders with different sizes.

To overcome the shortcomings, the present invention provides a rivet gun with a changeable cylinder to mitigate or obviate the aforementioned problems.

SUMMARY OF THE INVENTION

The main objective of the invention is to provide a rivet gun that has a handle connected detachably to a cylinder. Therefore, the cylinder may be replaced by another cylinder of a different size or type.

A rivet gun in accordance with the present invention has a barrel, a handle assembly, a cylinder and a seal ring assembly. The handle assembly is mounted under the barrel and has a hydraulic shaft and a handle mounted around the hydraulic shaft and having an annular shoulder. The cylinder has a top cover, an annular body and a bottom seat. The top cover is mounted under the handle and contacts the annular shoulder. A diameter of the top cover is larger than a diameter of the annular shoulder such that an outer periphery of the top cover protrudes radially out from an outer periphery of the annular shoulder instead of being covered by the annular shoulder. The annular body is mounted detachably on the top cover. The bottom seat is mounted detachably on the annular body. The rivet gun is allowed to change cylinders of different sizes or types.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
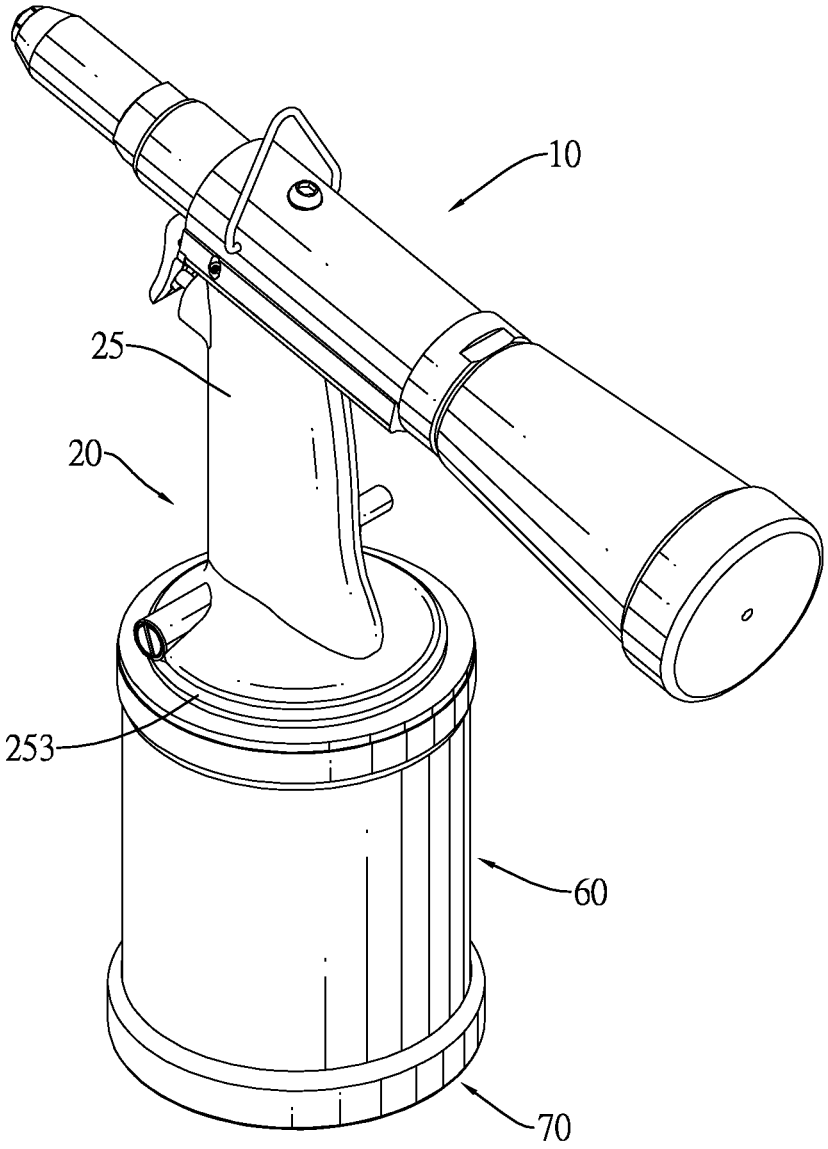
FIG. 1 is a perspective view of a rivet gun with a changeable cylinder in accordance with the present invention.
Figure 2:
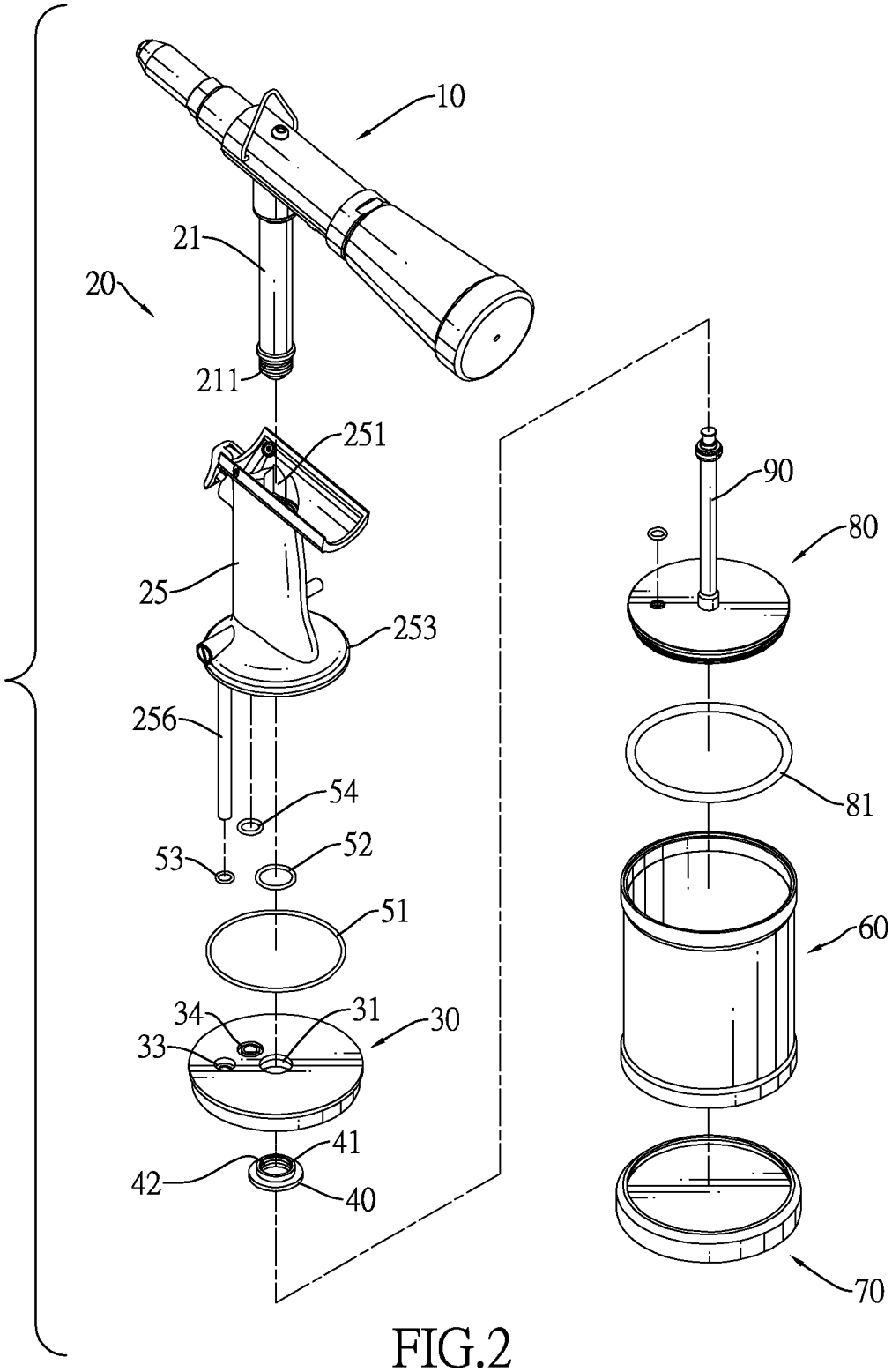
FIG. 2 is an exploded perspective view of the rivet gun in FIG. 1.

With reference to FIGS. 1 and 2, a rivet gun in accordance with the present invention comprises a barrel 10, a handle assembly 20, a cylinder and a seal ring assembly 50.

The barrel 10 has a front end, a rear end, a bottom side, a bore, a rivet driving assembly and a collection jar. The bore is defined through the barrel. The rivet driving assembly is mounted in the bore. The collection jar is mounted on the rear end of the barrel to collect broken core pins of rivets.

The handle assembly 20 is mounted on the barrel 10 and has a hydraulic shaft 21 and a handle 25.

Figure 3:
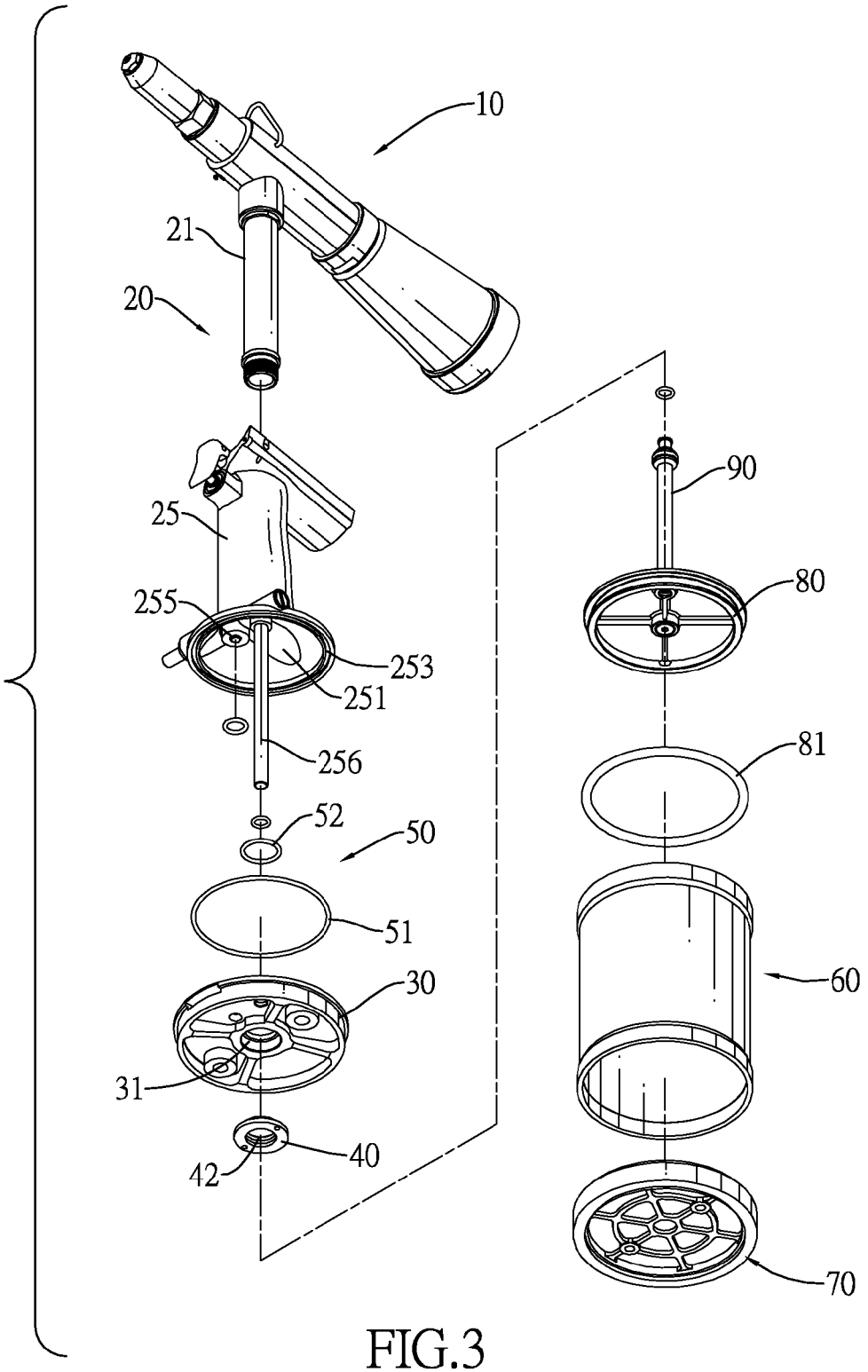
FIG. 3 is another exploded perspective view of the rivet gun in FIG. 1.
Figure 4:
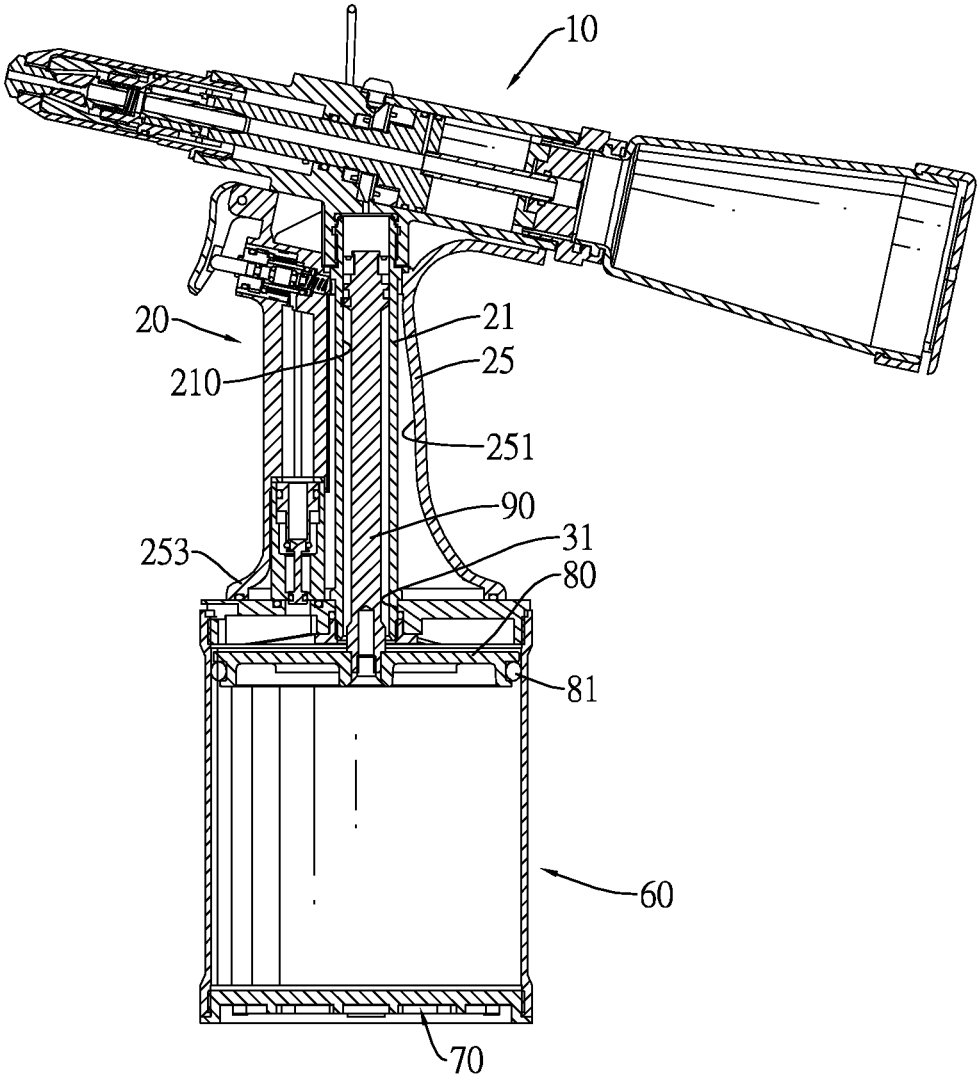
FIG. 4 is a cross sectional side view of the rivet gun in FIG. 1.
Figure 5:
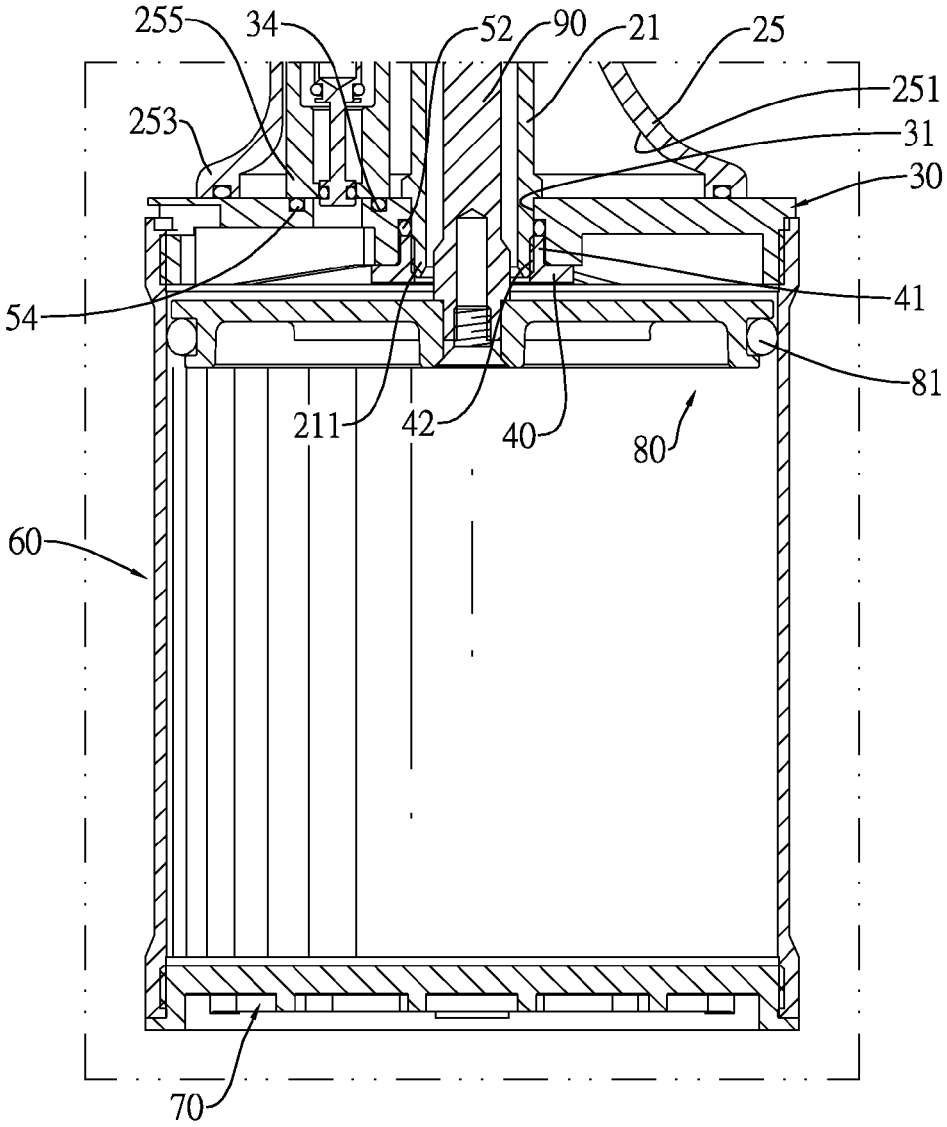
FIG. 5 is an enlarged cross sectional side view of the rivet gun in FIG. 4.

With further reference to FIGS. 3 to 5, the hydraulic shaft 21 is hollow, is mounted on the bottom side of the barrel 10, communicates with the bore and has a top end and a bottom end.

The handle 25 is mounted under the bottom side of the barrel 10 around the hydraulic shaft 21 and has a top end, a bottom end and an annular shoulder 253 formed on and protruding radially outward from the bottom end.

The cylinder is mounted detachably under the annular shoulder 253 of the handle 25 and has a top cover 30, a fastener 40, an annular body 60 and a bottom seat 70.

The top cover 30 is mounted on the bottom end of the hydraulic shaft 21, contacts the annular shoulder 253 and has a top surface, a bottom surface and a central hole 31. A diameter of the top cover 30 is larger than a diameter of the annular shoulder 253 such that an outer periphery of the top cover 30 protrudes radially out from an outer periphery of the annular shoulder 253 instead of being covered by the annular shoulder 253. The central hole 31 is defined through the top cover 30 and mounted around the hydraulic shaft 21. Furthermore, the top surface of the top cover 30 may be flat and have no engaging protrusions or engaging recesses.

The fastener 40 is mounted detachably on the bottom end of the hydraulic shaft 21 and abuts the bottom surface of the top cover 30 such that the top cover 30 is sandwiched securely between the annular shoulder 253 of the handle 25 and the fastener 40.

The annular body 60 is tubular, is mounted detachably on the bottom surface of the top cover 30 and has a top, a bottom and a cavity defined in the annular body 60.

The bottom seat 70 is mounted detachably on the bottom of the annular body 60.

The seal ring assembly 50 has a primary seal ring 51 mounted hermetically between the annular shoulder 253 and the top surface of the top cover 30.

In a preferred embodiment of the present invention, the handle 25 further has a control valve 255 formed on the bottom end of the handle 25 and having a bottom end. The top cover 30 further has a first through hole 34 defined through the top cover 30. The seal ring assembly further has a first seal ring 54 mounted hermetically in the first through hole 34 and hermetically contacting the bottom end of the control valve 255.

In a preferred embodiment of the present invention, the handle 25 further has an air inlet tube 256 mounted in the handle 25 and extending downward from the handle 25. The top cover 30 further has a second through hole 33 defined through the top cover 30 and mounted around the air inlet tube 256. The seal ring assembly 50 further has a second seal ring 53 mounted in the second through hole 33 and mounted around and hermetically contacting the air inlet tube 256.

In a preferred embodiment of the present invention, the hydraulic shaft 21 has an outer thread 211 formed on the bottom end. The fastener 40 is a nut having a mounting sleeve 41 and an inner thread formed on the mounting sleeve and engaging the outer thread 211 of the hydraulic shaft 21. Furthermore, the seal ring assembly 50 further has an inner seal ring 52 mounted between the nut and the bottom surface of the top cover 30 and mounted hermetically around the hydraulic shaft 21.

In a preferred embodiment of the present invention, the cylinder further has a piston 80 and a rod 90. The piston 80 is mounted slidably in the cavity of the annular body 60. The rod 90 is mounted on the piston 80 and has a top end extending slidably in the central hole of the hydraulic shaft 21. Furthermore, the piston 80 has a leak-proof seal ring 81 mounted around the piston 80.

Because the diameter of the top cover 30 is larger than that of the annular shoulder 253 of the handle 25, the outer periphery of the top cover 30 extends radially out from the annular shoulder 253 instead of being covered by the annular shoulder 253. Therefore, the top cover 30 and corresponding annular body 60 and bottom seat 70 may be replaced with others of different sizes or types. Because the top cover 30, annular body 60 and bottom seat 70 are detachable, damaged one of these components can be replaced quickly with a brand new one.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rivet gun comprising:

a barrel having a bottom side;

a handle assembly having a hydraulic shaft being hollow, mounted on the bottom side of the barrel and communicating with the barrel and having a bottom end;

a handle mounted under the bottom side of the barrel and around the hydraulic shaft and having a bottom end and an annular shoulder formed on and protruding radially outward from the bottom end;

a cylinder having a top cover mounted on the bottom end of the hydraulic shaft, contacting the annular shoulder and having a top surface, a bottom surface and a central hole defined through the top cover and mounted around the hydraulic shaft, wherein a diameter of the top cover is larger than a diameter of the annular shoulder such that an outer periphery of the top cover protrudes radially out from an outer periphery of the annular shoulder instead of being covered by the annular shoulder;

a fastener mounted detachably on the bottom end of the hydraulic shaft and abutting the bottom surface of the top cover such that the top cover is sandwiched securely between the annular shoulder of the handle and the fastener;

an annular body mounted detachably on the bottom surface of the top cover and having a cavity defined in the annular body; and a bottom seat mounted detachably on the bottom of the annular body; and a seal ring assembly having a primary seal ring mounted hermetically between the annular shoulder and the top surface of the top cover.

2. The rivet gun as claimed in claim 1, wherein the top surface of the top cover is flat without engaging protrusions or engaging recesses.

3. The rivet gun as claimed in claim 2, wherein the handle further has a control valve formed on the bottom end of the handle and having a bottom end;

the top cover further has a first through hole defined through the top cover; and the seal ring assembly further has a first seal ring mounted hermetically in the first through hole and hermetically contacting the bottom end of the control valve.

4. The rivet gun as claimed in claim 3, wherein the handle further has an air inlet tube mounted in the handle and extending downward from the handle;

the top cover further has a second through hole defined through the top cover and mounted around the air inlet tube; and the seal ring assembly further has a second seal ring mounted in the second through hole and mounted around and hermetically contacting the air inlet tube.

5. The rivet gun as claimed in claim 4, wherein the hydraulic shaft has an outer thread formed on the bottom end;

the fastener is a nut having a mounting sleeve and an inner thread formed on the mounting sleeve and engaging the outer thread of the hydraulic shaft; and the seal ring assembly further has an inner seal ring mounted between the nut and the bottom surface of the top cover and mounted hermetically around the hydraulic shaft.

6. The rivet gun as claimed in claim 5, wherein the cylinder further has a piston mounted slidably in the cavity of the annular body and a rod mounted on the piston and having a top end extending slidably in the central hole of the hydraulic shaft.

7. The rivet gun as claimed in claim 6, wherein the piston has a leak-proof seal ring mounted around the piston.

* * * * *